US007305736B2

(12) United States Patent
Moshenrose

(10) Patent No.: US 7,305,736 B2
(45) Date of Patent: Dec. 11, 2007

(54) HEIGHT ADJUSTMENT APPARATUS FOR A ROTATABLE COMPONENT OF A VACUUM CLEANER

(75) Inventor: Paul A. Moshenrose, Ocean Springs, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 683 days.

(21) Appl. No.: 10/818,326

(22) Filed: Apr. 5, 2004

(65) Prior Publication Data

US 2005/0218713 A1 Oct. 6, 2005

(51) Int. Cl.
*A47L 9/04* (2006.01)

(52) U.S. Cl. ..... 15/355; 15/368; 15/392

(58) Field of Classification Search ..... 15/355, 15/368, 392; *A47L 5/34*
See application file for complete search history.

(56) References Cited

U.S. PATENT DOCUMENTS 2,233,762 A 3/1941 Ashbaugh
2,336,710 A * 12/1943 Wied ..... 15/368
3,671,996 A 6/1972 Gaudry
3,959,847 A 6/1976 Kaulig et al.
4,221,019 A 9/1980 Haase et al.
4,467,495 A 8/1984 Fish et al.
5,551,120 A 9/1996 Cipolla et al.
6,279,196 B2 8/2001 Kasen et al.
6,446,302 B1 9/2002 Kasper et al.

* cited by examiner

*Primary Examiner*—Theresa T. Snider
(74) *Attorney, Agent, or Firm*—The Ollila Law Group LLC

(57) ABSTRACT

A height adjustment apparatus for a rotatable component of a vacuum cleaner is provided. The apparatus includes a rotatable wheel and a retainer device. The rotatable wheel includes a central axis, a wheel portion, a hub portion including an offset axle aperture that receives a rotatable component, and one or more detent devices. The retainer device is retained in a chassis of the vacuum cleaner and includes a body, a hub portion aperture formed in the body and of a size to rotatably receive the hub portion of the rotatable wheel, and one or more biasing devices that interact with the one or more detent devices in order to provide a plurality of predetermined detent positions. The rotatable component is moved substantially vertically with respect to the central axis when the rotatable wheel is rotated between the plurality of predetermined detent positions.

33 Claims, 6 Drawing Sheets

HEIGHT ADJUSTMENT APPARATUS FOR A ROTATABLE COMPONENT OF A VACUUM CLEANER

TECHNICAL FIELD

The present invention relates to a height adjustment apparatus for a rotatable component of a vacuum cleaner.

BACKGROUND OF THE INVENTION

Vacuum cleaners are widely used for picking up dirt and debris. A vacuum cleaner therefore includes a motor and impeller that together generate a vacuum airflow. A powered brushroll is rotated by a motor and functions to dislodge dirt and debris on an underlying surface and propel the dirt and debris into the vacuum airflow. The brushroll therefore is an important device for enhancing the cleaning ability of a vacuum cleaner.

A vacuum cleaner can be used on a variety of underlying surfaces. For example, the vacuum cleaner and powered brushroll can be used to pickup dirt and debris on carpeting. Furthermore, the vacuum cleaner and powered brushroll can be used to pickup dirt and debris deep down among carpet fibers. Alternatively, the vacuum cleaner and brushroll can be used on hard, flat surfaces, such as wood floors, tile, linoleum, etc. These underlying surfaces can vary greatly in their firmness, flatness, evenness, texture, etc. Because of variations in firmness, the wheels of the vacuum cleaner can sink into the surface, such as a carpeted surface, and the distance from the brushroll to the surface can change. Because the bristles of the brushroll are of a fixed length, this height variation will undesirably affect the amount of contact between the brushroll and the underlying surface.

In the prior art, the most common approach is to have a brushroll of a fixed height. Therefore, when moving from a hardwood floor to a carpet, when moving from a carpet to a hardwood floor, or when moving from a carpet of one depth and density to another carpet having a different depth and density, the height of the brushroll from the underlying surface will change. As a result, the effectiveness of the brushroll will be greatly impacted.

In another prior art approach, the wheels of the vacuum cleaner are adjustable and the entire vacuum cleaner can be raised and lowered. Although this accommodates different underlying surfaces and/or textures, the consequence of changing the height of the entire vacuum cleaner is that the distance of the nozzle and therefore the vacuum airflow is changed in relation to the underlying surface. This will unfortunately affect the cleaning power of the vacuum airflow and therefore of the vacuum cleaner.

SUMMARY OF THE INVENTION

A height adjustment apparatus for a rotatable component of a vacuum cleaner is provided according to an embodiment of the invention. The height adjustment apparatus comprises a rotatable wheel and a retainer device. The rotatable wheel comprises a central axis, a wheel portion substantially centered on the central axis and adapted to be rotated, a hub portion substantially centered on the central axis and including an offset axle aperture that is offset from the central axis, with the offset axle aperture being adapted to receive at least a portion of a rotatable component, and one or more detent devices formed as part of the hub portion. The retainer device is retained in a chassis of the vacuum cleaner and comprises a body, a hub portion aperture formed in the body and of a size to rotatably receive the hub portion of the rotatable wheel, and one or more biasing devices that interact with the one or more detent devices of the hub portion in order to provide a plurality of predetermined detent positions to the height adjustment apparatus. The rotatable component is moved substantially vertically with respect to the central axis when the rotatable wheel is rotated between the plurality of predetermined detent positions. A rotatable component height is changed by rotation of the rotatable wheel.

A height adjustment system for a rotatable component of a vacuum cleaner is provided according to an embodiment of the invention. The height adjustment system comprises a brushroll including a first axle portion extending from a first end of the brushroll and a second axle portion extending from a second end. The height adjustment system further comprises a first rotatable wheel apparatus affixed to a chassis of the vacuum cleaner and including a first offset axle aperture that receives the first axle portion of the brushroll. The first offset axle aperture moves the first axle portion relative to a first rotatable wheel apparatus central axis when the first rotatable Wheel apparatus is rotated with respect to the chassis. The height adjustment system further comprises a second rotatable wheel apparatus affixed to the chassis and including a second offset axle aperture that receives the second axle portion of the brushroll. The second offset axle aperture moves the second axle portion relative to a second rotatable wheel apparatus central axis when the second rotatable wheel apparatus is rotated with respect to the chassis.

A height adjustment method for adjusting a height of a rotatable component of a vacuum cleaner is provided according to an embodiment of the invention. The method comprises providing a rotatable wheel comprising a central axis, a wheel portion substantially centered on the central axis and adapted to be rotated, a hub portion substantially centered on the central axis and including an offset axle aperture that is offset from the central axis, with the offset axle aperture being adapted to receive a portion of a rotatable component, and one or more detent devices formed as part of the hub portion. The method further comprises providing a retainer device adapted to be retained in a chassis of the vacuum cleaner, with the retainer device comprising a body, a hub portion aperture formed in the body and of a size to rotatably receive the hub portion of the rotatable wheel, and one or more biasing devices that interact with the one or more detent devices of the hub portion in order to provide a plurality of predetermined detent positions to the height adjustment apparatus, wherein the rotatable component is moved substantially vertically with respect to the central axis when the rotatable wheel is rotated between the plurality of predetermined detent positions.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-6 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
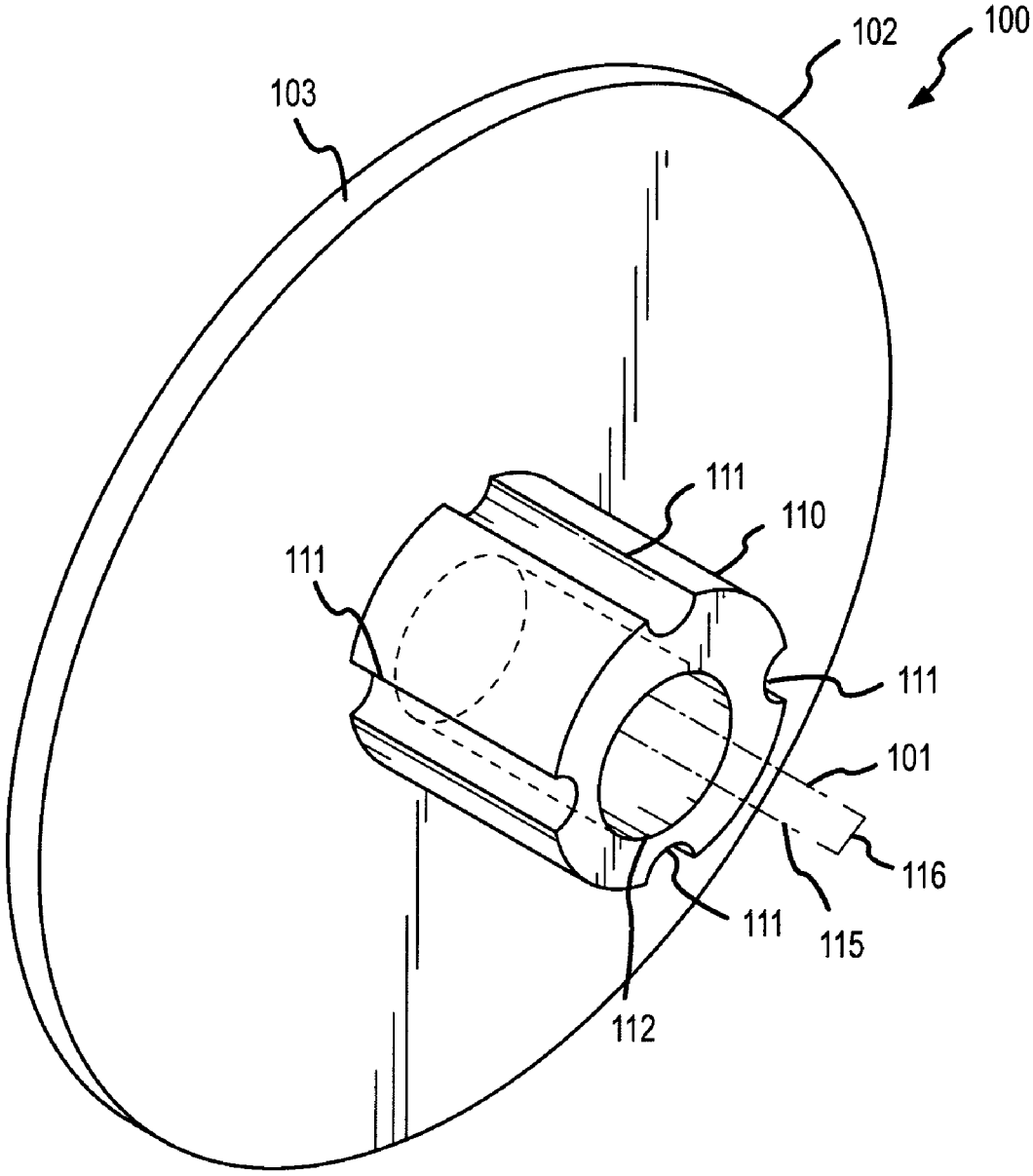
FIG. 1 shows rotatable wheel that is a component of a vacuum cleaner height adjustment apparatus according to an embodiment of the invention.

FIG. 1 shows rotatable wheel 100 that is a component of a vacuum cleaner height adjustment apparatus 300 according to an embodiment of the invention. The rotatable wheel 100 is formed substantially around a central axis 101. The rotatable wheel 100 rotatably receives at least a portion of a rotatable component 400 (see FIG. 4).

The rotatable wheel 100 includes a wheel portion 102 and a hub portion 110. The rotatable wheel 100 can be rotated by a power source 601 (see FIG. 6), or can be manually rotated. The wheel portion 102 in one embodiment includes a contact surface 103. The contact surface 103 is located on a substantially circumferential portion of the wheel portion 102. The contact surface 103 in one embodiment includes friction features that enable a user of the vacuum cleaner to manually rotate the wheel portion 102. The friction features can include grooves (see FIG. 3), knurling, ridges, roughening, etc. It should be understood that although the term wheel is used throughout this discussion, the wheel portion 102 does not have to be circular, and other geometries can be employed as desired.

The hub portion 110 is also formed substantially around the central axis 101. The hub portion 110 can include one or more detent devices 111 formed into an outer cylindrical surface of the hub portion. Alternatively, the hub portion 110 can be non-cylindrical, such as rectangular, triangular, oval, hexagonal, etc., wherein the shape of the hub portion 110 acts as a detent device.

The hub portion 110 further includes an offset axle aperture 112 formed around an offset axis 115. The offset axle aperture 112 passes partially or completely through the rotatable wheel 100. The offset axle aperture 112 is substantially circular in one embodiment. The offset axis 115 is offset from the central axis 101 by an offset distance 116. The amount of offset distance 116 can be varied according to the size of the offset axle aperture 112 and the desired range of movement of the rotatable component 400. Therefore, when the rotatable wheel 100 is rotatably mounted to a vacuum cleaner, the rotatable component 400 residing in the offset axle aperture 112 will be moved relative to the vacuum cleaner upon rotation of the rotatable wheel 100.

The hub portion 110 further includes one or more detent devices 111 formed in a circumferential surface of the hub portion 110. The one or more detent devices 111 cooperate with biasing devices 204 (see FIGS. 2-3) in order to provide a plurality of detent positions and further in order to hold the rotatable wheel 100 at fixed rotational detent positions. The rotatable wheel 100 can therefore be rotated between the plurality of detent positions. As a result, the one or more detent devices 111 prevent unwanted rotation of the rotatable wheel 100.

The one or more detent devices 111 can be spaced equidistantly, or can be arranged according to any predefined spacing or any predefined pattern. In the embodiment shown, the one or more detent devices 111 comprise substantially semi-circular grooves. However, it should be understood that the one or more detent devices 111 can be formed in any shape, including recesses into or extensions out of the hub portion 110.

Figure 2:
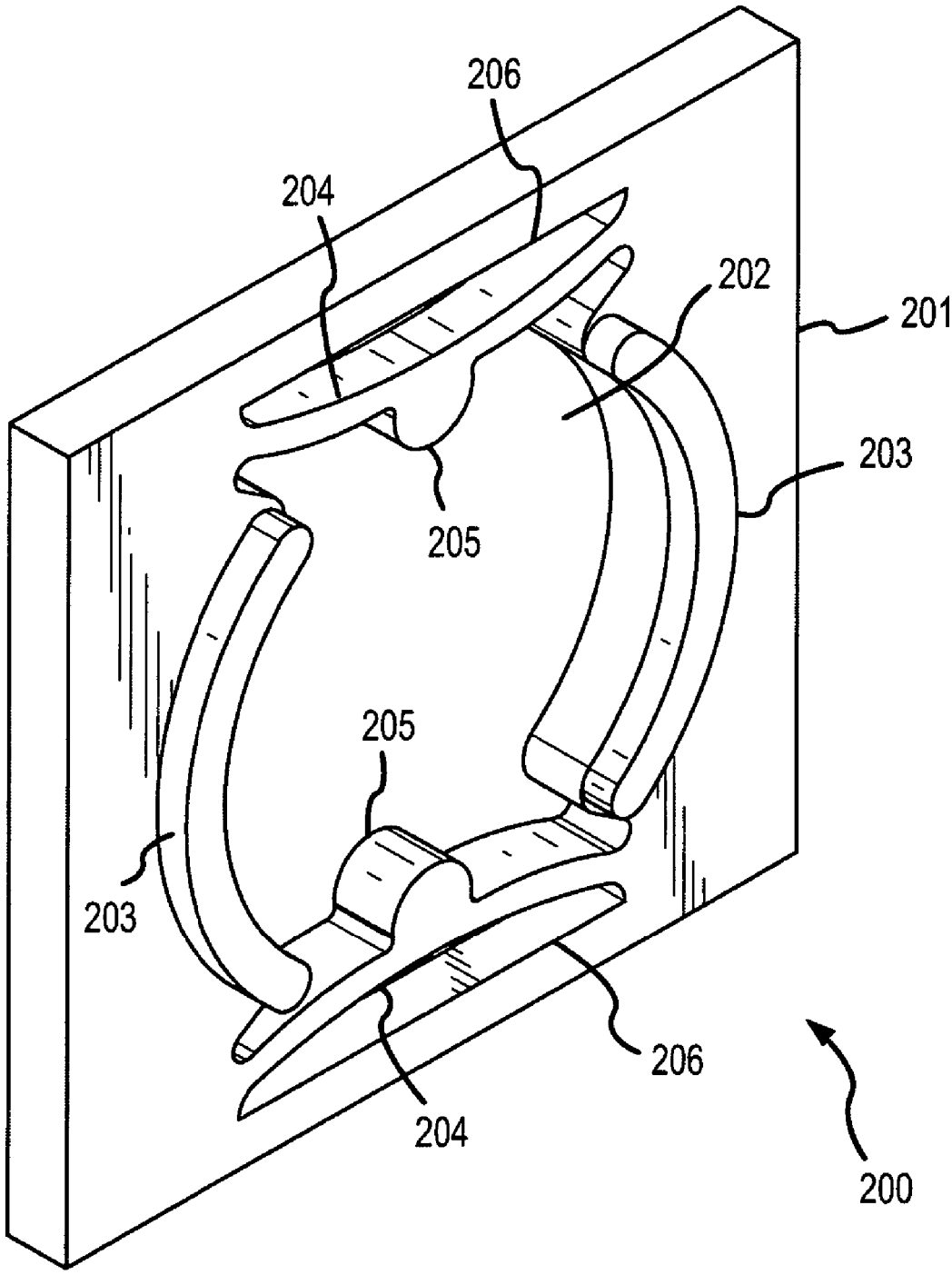
FIG. 2 shows a retainer device that is a component of the vacuum cleaner height adjustment apparatus according to an embodiment of the invention.

FIG. 2 shows a retainer device 200 that is a component of the vacuum cleaner height adjustment apparatus 300 according to an embodiment of the invention. The retainer device 200 includes a body 201, a hub portion aperture 202, one or more ridges 203, and biasing devices 204. The hub portion 110 of the rotatable wheel 100 passes through the hub portion aperture 202 (see FIG. 3). In addition, at least a portion of a rotatable component, such as a rotatable component axle portion, passes through the hub portion aperture 202. The rotatable component axle is received in the offset axle aperture 112 of the hub portion 110 (see FIG. 4).

The retainer device 200 can be formed of any suitable material and of any suitable size or shape. The generally rectangular shape depicted in the figure is an illustration of an exemplary embodiment, and can be varied and still fall within the scope of the specification and claims.

The one or more biasing devices 204 comprise resilient members that cooperate with the one or more detent devices 111 of the rotatable wheel 100. A biasing device 204 in the embodiment shown comprises a projection 205 formed on a resilient member, such as a leaf spring-like member, for example. The biasing device 204 is formed between a cut-out 206 in the retainer device 200 and the hub portion aperture 202. The projection 204 is adapted to engage the one or more detent devices 111.

It should be understood that the one or more biasing devices 204 can be formed in other ways. In addition, extra components can be bonded to or assembled to the biasing device 204 in order to provide or enhance a resiliency of the biasing device 204. The resulting biasing device 204 can flex, wherein the projection 205 normally resides in a detent device 111, but will flex and ride out of the detent device 111 when the rotatable wheel 100 is rotated by application of a rotational force. The one or more biasing devices 204 therefore provide a detent force that normally holds the rotatable wheel 100 in a fixed position of the plurality of detent positions.

It should be understood that the number of biasing devices 204 does not have to correspond to the number of detent devices 111 of the rotatable wheel 100. For example, one biasing device 204 could satisfactorily cooperate with multiple detent devices 111, one detent device 111 could satisfactorily cooperate with multiple biasing devices 204, etc.

Figure 3:
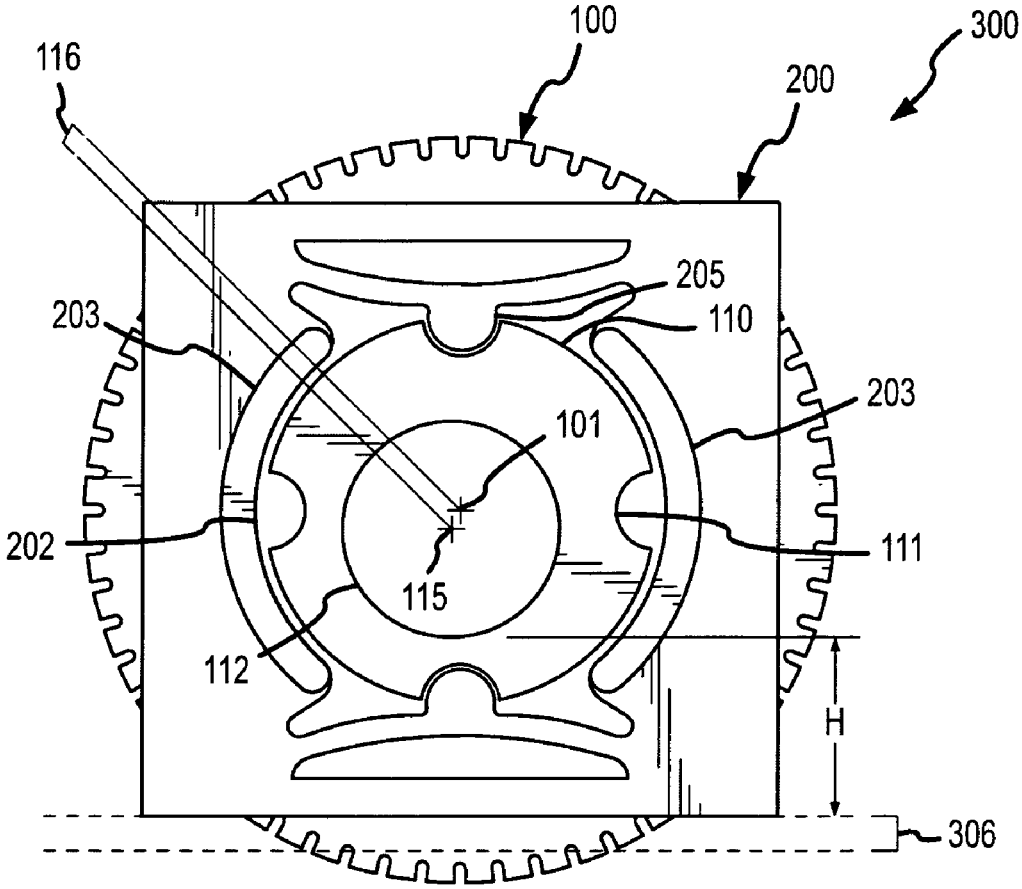
FIG. 3 shows the assembled vacuum cleaner height adjustment apparatus according to an embodiment of the invention.

FIG. 3 shows the assembled vacuum cleaner height adjustment apparatus 300 according to an embodiment of the invention. The hub portion 110 of the rotatable wheel 100 passes through the hub portion aperture 202 of the retainer device 200. The projections 205 can engage detent devices 111 of the hub portion 110. The ridges 203 can extend outside and along a rotatable component, such as a brushroll (see FIG. 4).

This figure again shows the offset distance 116 between the central axis 101 of the rotatable wheel and the offset axis 115 of the offset axle aperture 112. It can be visualized from this view that the distance H can be varied by rotating the rotatable wheel 100. It can be seen from the figure that the position of the offset axle aperture 112 will describe an arcing path as the rotatable wheel 100 is rotated. As a consequence, the rotatable component residing in the offset axle aperture 112 will move substantially vertically with respect to the central axis 101 when the rotatable wheel 100 is rotated between the plurality of detent positions. Therefore, as the distance H changes, the height of the offset axle aperture 112 (and therefore the rotatable component) from an underlying surface will likewise be changed. As a result, the height of the rotatable component from an underlying surface can be manually adjusted or adjusted through actuation of a power source 601.

The dashed lines 306 illustrate a typical casing thickness of a vacuum cleaner. The retainer device 200 in one embodiment rests against an interior casing surface (upper dashed line) while the rotatable wheel 100 extends outside the outer casing surface (lower dashed line). This is further shown in FIG. 5.

Figure 4:
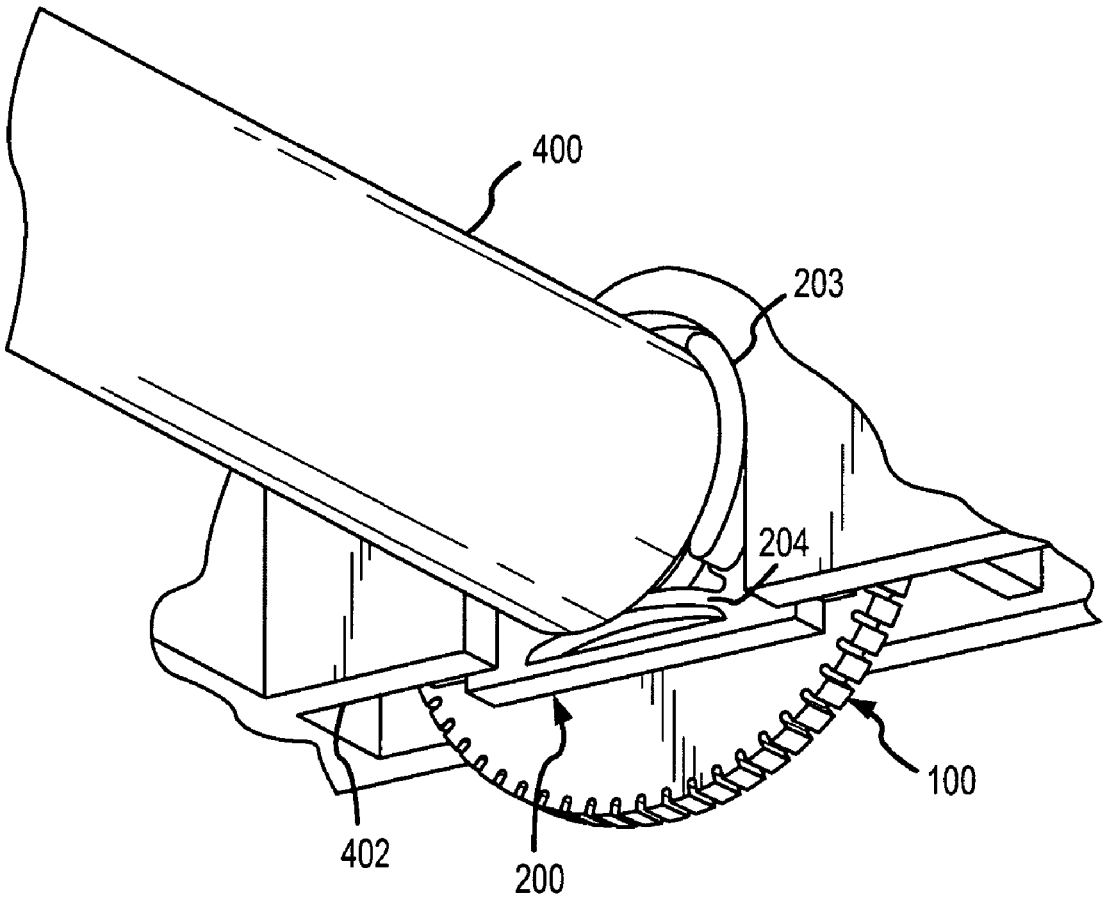
FIG. 4 shows the rotatable wheel and retainer device assembled together and assembled into a vacuum cleaner chassis.

FIG. 4 shows the rotatable wheel 100 and retainer device 200 assembled together and assembled into a vacuum cleaner chassis 402. The retainer device 200 can fit into a slot, frame, or other mounting device of the vacuum cleaner chassis 402. The retainer device 200 can be permanently or removably held in the vacuum cleaner chassis 402 by any manner of adhesive, weld, fasteners, clips, mounting pieces, etc. A rotatable component 400, such as a brushroll 400, is received in the offset axle aperture 112 and can rotate therein. Alternatively, the rotatable component 400 can comprise a wheel of the vacuum cleaner. An axle portion of the rotatable component 400 can extend through a corresponding rotatable wheel 100, and a pulley, gear, drive motor, etc., can fit to the axle portion after it passes through the rotatable wheel 100.

In one embodiment, a brushroll 400 can be supported and adjusted by a first rotatable wheel together with a second rotatable wheel. Each rotatable wheel adjusts a height of an end of the brushroll 400. A first offset axle aperture moves a first axle portion relative to a first rotatable wheel apparatus central axis when the first rotatable wheel apparatus is rotated with respect to the chassis. Likewise, a second offset axle aperture moves a second axle portion relative to a second rotatable wheel apparatus central axis when the second rotatable wheel apparatus is rotated with respect to the chassis.

In one embodiment, the first rotatable wheel apparatus is capable of rotating independently of the second rotatable wheel apparatus. Alternatively, in another embodiment the first rotatable wheel apparatus is constrained to rotate with the second rotatable wheel apparatus. For example, the first rotatable wheel apparatus can be connected to the second rotatable wheel apparatus in some manner.

In one embodiment, the first rotatable wheel apparatus and the second rotatable wheel apparatus are manually adjusted. Alternatively, in another embodiment the first rotatable wheel apparatus and the second rotatable wheel apparatus are rotated by one or more power sources 601.

Figure 5:
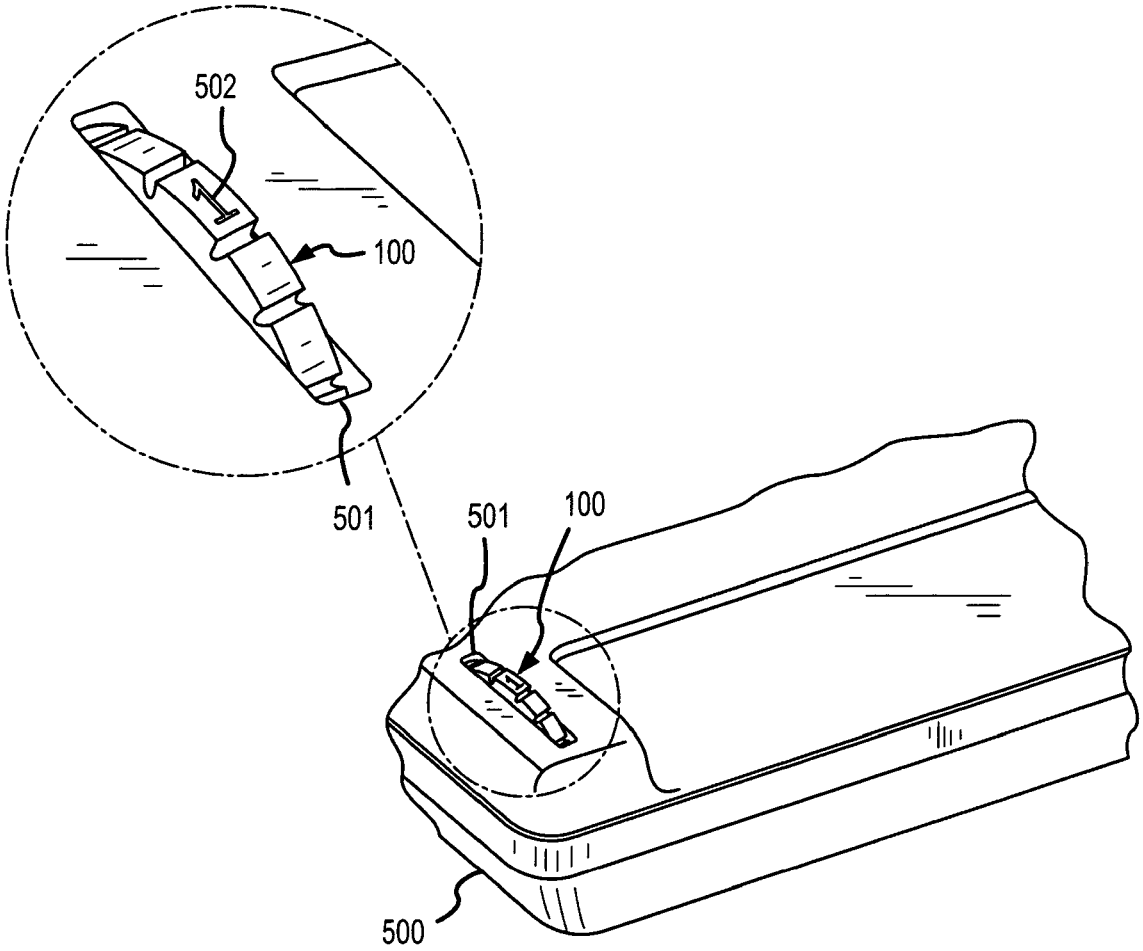
FIG. 5 shows the rotatable wheel extending out of a wheel aperture of a vacuum cleaner.

FIG. 5 shows the rotatable wheel 100 extending out of a wheel aperture 501 of a vacuum cleaner 500. The wheel aperture 501 is included in order to allow the end user to access the rotatable wheel 100 without disassembling the unit. The wheel aperture 501 can be formed in a top cover, a bottom plate, or other portion of the exterior of the vacuum cleaner. The rotatable wheel 100 can extend out by a predetermined distance. The rotatable wheel 100 can include one or more height indicia 502 that display a height and/or position of the rotatable component 400. The one or more height indicia 502 can comprise numbers, letters, etc. A user can view the one or more height indicia 502 in order to determine a proper rotational position of the rotatable wheel 100 and therefore a relative height of the rotatable component 400. In one embodiment, the rotatable wheel 100 therefore controls a height of a brushroll above an underlying surface. By rotating the rotatable wheel 100, the engagement of the brush with the underlying surface will increase or decrease by a predetermined amount.

Figure 6:
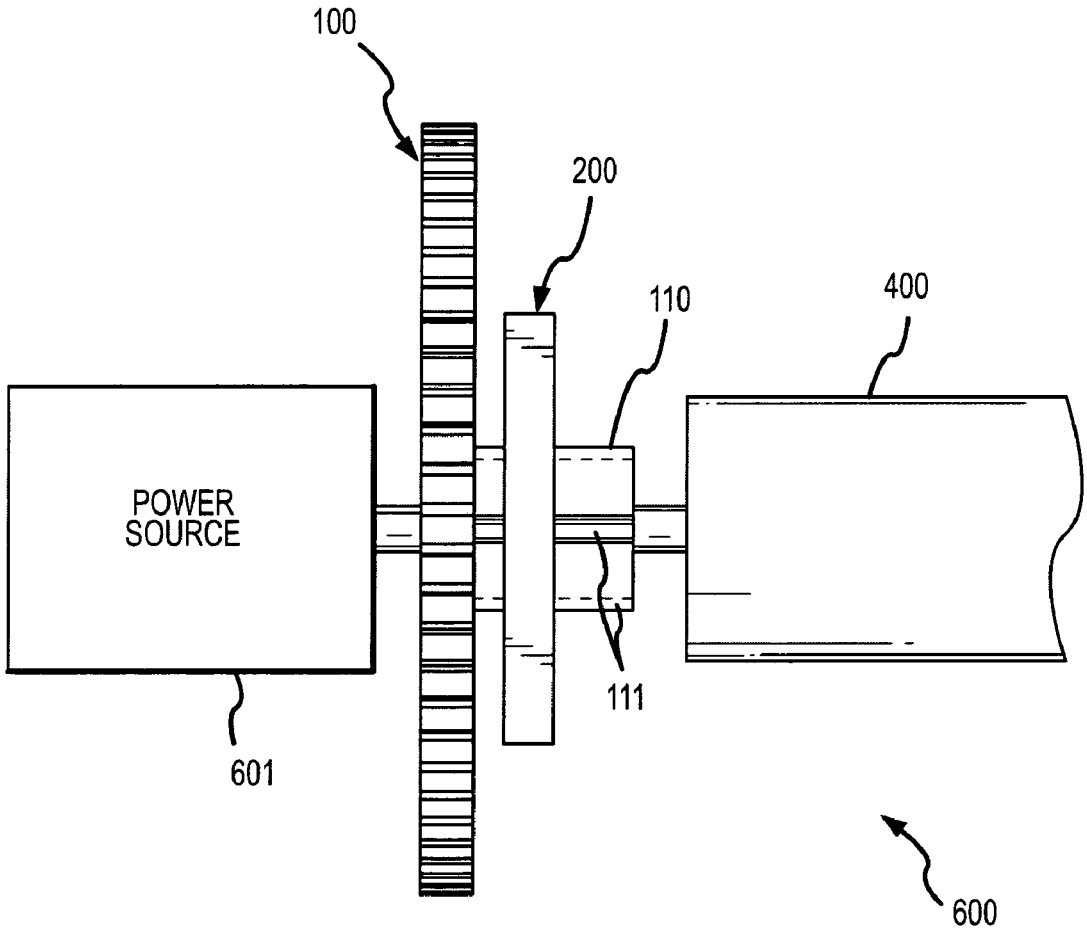
FIG. 6 shows a height adjustment apparatus according to an embodiment of the invention.

FIG. 6 shows a height adjustment apparatus 600 according to an embodiment of the invention. The height adjustment apparatus 600 in this embodiment is powered by a power source 601. The height adjustment apparatus 600 can apply to any of the previous embodiments. The height adjustment apparatus 600 includes the rotatable wheel 100 and the hub portion 110, the retainer device 200, and the power source 601. The power source 601 can provide rotational power to the rotatable wheel 100. Consequently, the power source 601 can provide a height adjustment to the rotatable component 400.

The power source 601 can comprise any suitable rotational power source. In one embodiment, the power source 601 can comprise an electric motor, a geared electric motor, a stepper motor, etc. Other power source types are contemplated and are included in the scope of the description and claims.

The vacuum cleaner height adjustment apparatus according the invention can be implemented according to any of the embodiments in order to obtain several advantages, if desired. The vacuum cleaner height adjustment apparatus enables a manual or powered height adjustment of a rotatable component. The height can comprise a height of the rotatable component above an underlying surface. The vacuum cleaner height adjustment apparatus is simple, inexpensive, sturdy, and easy to use. The vacuum cleaner height adjustment apparatus enables a brushroll height to be adjusted at any time. The vacuum cleaner height adjustment apparatus provides a visual height indication.

What is claimed is:

1. A height adjustment apparatus adapted for a rotatable component of a vacuum cleaner, comprising:

a rotatable wheel comprising:

a central axis;

a wheel portion substantially centered on the central axis and adapted to be rotated, wherein the wheel portion (102) extends at least partially through a wheel aperture in a vacuum cleaner exterior;

a hub portion substantially centered on the central axis and including an offset axle aperture that is offset from the central axis, with the offset axle aperture being adapted to receive at least a portion of the rotatable component;

one or more detent devices formed as part of the hub portion;

a retainer device adapted to be retained in a chassis of the vacuum cleaner, with the retainer device comprising:

a body;

a hub portion aperture formed in the body and of a size to rotatably receive the hub portion of the rotatable wheel;

one or more biasing devices that interact with the one or more detent devices of the hub portion in order to provide a plurality of predetermined detent positions to the height adjustment apparatus, wherein the rotatable component is moved substantially vertically with respect to the central axis when the rotatable wheel is rotated between the plurality of predetermined detent positions; and wherein a rotatable component height is changed by rotation of the rotatable wheel.

2. The apparatus of claim 1, further comprising a power source connected to the rotatable wheel, wherein the power source provides rotational power to the rotatable wheel.

3. The apparatus of claim 1, wherein the wheel portion is adapted to be manually rotated.

4. The apparatus of claim 1, wherein the rotatable component height is changed by rotation of the rotatable wheel without changing a nozzle height.

5. The apparatus of claim 1, with the rotatable wheel including a contact surface on a substantially circumferential portion of the wheel portion and with the contact surface including friction features.

6. The apparatus of claim 1, with the rotatable wheel including one or more height indicia on a substantially circumferential portion of the wheel portion.

7. The apparatus of claim 1, wherein the rotatable wheel is adapted to be manually rotated from outside the vacuum cleaner.

8. The apparatus of claim 1, with the one or more detent devices comprising one or more grooves and with the one or more biasing devices comprising one or more spring-like members.

9. The apparatus of claim 1, with a biasing device of the one or more biasing devices comprising a resilient member formed between a cut-out in the retainer device and the hub portion aperture and further comprising a projection formed on the resilient member, with the projection being adapted to engage the one or more detent devices.

10. The apparatus of claim 1, wherein the retainer device is removably retained in the chassis.

11. A height adjustment system adapted for adjusting a brushroll height of a vacuum cleaner, comprising:

a brushroll including a first axle portion extending from a first end of the brushroll and a second axle portion extending from a second end;

a first rotatable wheel apparatus extending at least partially through a first wheel aperture in a vacuum cleaner exterior and affixed to a chassis of the vacuum cleaner and including a first offset axle aperture that receives the first axle portion of the brushroll, wherein the first offset axle aperture moves the first axle portion relative to a first rotatable wheel apparatus central axis when the first rotatable wheel apparatus is rotated with respect to the chassis; and a second rotatable wheel apparatus affixed to the chassis and including a second offset axle aperture that receives the second axle portion of the brushroll, wherein the second offset axle aperture moves the second axle portion relative to a second rotatable wheel apparatus central axis when the second rotatable wheel apparatus is rotated with respect to the chassis.

12. The system of claim 11, wherein the first rotatable wheel apparatus and the second rotatable wheel apparatus are removably affixed to the chassis.

13. The system of claim 11, wherein the second rotatable wheel apparatus is adapted to extend at least partially through a second wheel aperture in the vacuum cleaner exterior.

14. The system of claim 11, wherein the first rotatable wheel apparatus is capable of rotating independently of the second rotatable wheel apparatus.

15. The system of claim 11, wherein the first rotatable wheel apparatus is constrained to rotate with the second rotatable wheel apparatus.

16. The system of claim 11, wherein the brushroll height is changed by rotation of the first rotatable wheel apparatus and the second rotatable wheel apparatus without changing a nozzle height.

17. The system of claim 11, wherein:

the first rotatable wheel apparatus comprises:

a first rotatable wheel that extends at least partially through the first wheel aperture in the vacuum cleaner exterior, the rotatable wheel, comprising:

a first central axis;

a first wheel portion substantially centered on the first central axis and adapted to be rotated;

a first hub portion substantially centered on the first central axis and including the first offset axle aperture, wherein the first offset aperture is offset from the first central axis and adapted to receive at least a portion of the first axle portion;

one or more first detent devices formed as part of the first hub portion;

a first retainer device adapted to be retained in the chassis of the vacuum cleaner, with the first retainer device comprising:

a first body;

a first hub portion aperture formed in the first body, wherein the first hub portion aperture is of a size to rotatably receive the first hub portion of the first rotatable wheel;

one or more first biasing devices;

the second rotatable wheel apparatus comprises:

a second rotatable wheel, comprising:

a second central axis;

a second wheel portion substantially centered on the second central axis and adapted to be rotated;

a second hub portion subsubstantially centered on the second central axis and including the second offset axle aperture, wherein the second offset aperture is offset from the second central axis and adapted to receive at least a portion of the second axle portion;

one or more second detent devices formed as part of the second hub portion;

a second retainer device adapted to be retained in the chassis of the vacuum cleaner, with the second retainer device comprising:

a second body;

a second hub portion aperture formed in the second body, wherein the second hub portion aperture is of a size to rotatably receive the second hub portion of the second rotatable wheel;

one or more second biasing devices; and wherein the one or more first biasing devices interact with the one or more first detent devices of the first hub portion and the one or more second biasing devices interact with the one or more second detent devices of the second hub portion in order to provide a plurality of predetermined detent positions to the height adjustment system, wherein the first and second axle portions are moved substantially vertically with respect to the central axes when the first and second rotatable wheels are rotated between the plurality of predetermined detent positions.

18. The system of claim 17, further comprising one or more power sources connected to the first rotatable wheel apparatus and the second rotatable wheel apparatus, wherein the one or more power sources provide rotational power to the first rotatable wheel apparatus and the second rotatable wheel apparatus.

19. The system of claim 17, wherein the first and second wheel portions of the first rotatable wheel apparatus and the second rotatable wheel apparatus are adapted to be manually rotated.

20. The system of claim 17, with the first rotatable wheel apparatus and the second rotatable wheel apparatus each including a contact surface on a substantially circumferential portion of the first and second wheel portions and with the contact surface including friction features.

21. The system of claim 17, with at least one of the first and second rotatable wheels including one or more height indicia on a substantially circumferential portion of at least one of the first and second wheel portions.

22. The system of claim 17, with the one or more first and second detent devices comprising one or more grooves and with the one or more first and second biasing devices comprising one or more spring-like members.

23. The system of claim 17, with a biasing device of the one or more first and second biasing devices comprising a resilient member formed between a cut-out in the first and second retainer devices and the first and second hub portion apertures and further comprising a projection formed on the resilient member, with the projection on the biasing device of the one or more first biasing devices being adapted to engage the one or more first detent devices and the projection on the biasing device of the one or more second biasing devices being adapted to engage the one or more second detent devices.

24. A height adjustment method for adjusting a height of a rotatable component of a vacuum cleaner, comprising:

providing a rotatable wheel extending at least partially through a wheel aperture in the vacuum cleaner exterior comprising a central axis, a wheel portion substantially centered on the central axis and adapted to be rotated, a hub portion substantially centered on the central axis and including an offset axle aperture that is offset from the central axis, with the offset axle aperture being adapted to receive a portion of a rotatable component, and one or more detent devices formed as part of the hub portion; and providing a retainer device adapted to be retained in a chassis of the vacuum cleaner, with the retainer device comprising a body, a hub portion aperture formed in the body and of a size to rotatably receive the hub portion of the rotatable wheel, and one or more biasing devices that interact with the one or more detent devices of the hub portion in order to provide the rotatable wheel with a plurality of predetermined detent positions, wherein the rotatable component is moved substantially vertically with respect to the central axis when the rotatable wheel is rotated between the plurality of predetermined detent positions.

25. The method of claim 24, further comprising providing a power source connected to the rotatable wheel, wherein the power source provides rotational power to the rotatable wheel.

26. The method of claim 24, wherein the wheel portion is adapted to be manually rotated.

27. The method of claim 24, wherein the rotatable component height is changed by rotation of the rotatable wheel without changing a nozzle height.

28. The method of claim 24, wherein the rotatable wheel is adapted to be manually rotated from outside the vacuum cleaner.

29. The method of claim 24, further comprising providing a contact surface on a substantially circumferential portion of the wheel portion and wherein the contact surface includes friction features.

30. The method of claim 24, further comprising providing one or more height indicia on a substantially circumferential portion of the wheel portion.

31. The method of claim 24, with the one or more detent devices comprising one or more grooves and with the one or more biasing devices comprising one or more spring-like members.

32. The method of claim 24, with a biasing device of the one or more biasing devices comprising a resilient member formed between a cut-out in the retainer device and the hub portion aperture and further comprising a projection formed on the resilient member, with the projection being adapted to engage the one or more detent devices.

33. The method of claim 24, wherein the retainer device is removably retained in the chassis.

* * * * *